US009657901B2

(12) United States Patent
Barker

(10) Patent No.: US 9,657,901 B2
(45) Date of Patent: May 23, 2017

(54) COMPRESSED AND LIQUIFIED NATURAL GAS STORAGE AND DISPENSING SYSTEM

(71) Applicant: R. Keith Barker, Walhalla, SC (US)

(72) Inventor: R. Keith Barker, Walhalla, SC (US)

(73) Assignee: HOLYSTONE USA, INC., Reisterstown, MD (US)

( * ) Notice: Subject to any disclaimer, the term of this patent is extended or adjusted under 35 U.S.C. 154(b) by 239 days.

(21) Appl. No.: 14/276,401

(22) Filed: May 13, 2014

(65) Prior Publication Data

US 2014/0338370 A1 Nov. 20, 2014

Related U.S. Application Data

(60) Provisional application No. 61/855,363, filed on May 14, 2013.

(51) Int. Cl.

| | |
|---|---|
| ***F17C 9/02*** | (2006.01) |
| ***F17C 7/04*** | (2006.01) |
| ***F17C 5/02*** | (2006.01) |
| *F17C 13/08* | (2006.01) |
| *F17C 5/00* | (2006.01) |

(52) U.S. Cl.

CPC ..... *F17C 7/04* (2013.01); *F17C 5/02* (2013.01); *F17C 5/002* (2013.01); *F17C 13/084* (2013.01); *F17C 2250/043* (2013.01); *F17C 2250/0434* (2013.01)

(58) Field of Classification Search

CPC .. F17C 7/04; F17C 13/084; F17C 5/02; F17C 5/002; F17C 2250/043; F17C 2250/0434

See application file for complete search history.

(56) References Cited

U.S. PATENT DOCUMENTS

| | | | | |
|---|---|---|---|---|
| 5,207,530 | A * | 5/1993 | Brooks | F17C 1/007 405/53 |
| 5,884,488 | A * | 3/1999 | Gram | F04B 15/08 417/901 |
| 6,474,101 | B1 * | 11/2002 | Quine | F17C 7/04 62/50.2 |
| 6,899,146 | B2 * | 5/2005 | Bingham | F17C 7/02 141/11 |
| 7,624,770 | B2 * | 12/2009 | Boyd | F17C 5/007 141/11 |
| 2005/0016185 | A1 * | 1/2005 | Emmer | F17C 5/007 62/50.1 |
| 2006/0005895 | A1 * | 1/2006 | Gram | F04B 5/02 141/104 |

* cited by examiner

*Primary Examiner* — Jianying Atkisson
*Assistant Examiner* — David Teitelbaum
(74) *Attorney, Agent, or Firm* — Thomas C. Saitta

(57) ABSTRACT

A compressed natural gas storage and dispensing system having bulk storage tanks in fluid communication with a natural gas supply source; a compressor to produce compressed natural gas; dispensing storage tanks in fluid communication with the bulk storage tanks and in fluid communication with fuel dispensers; a liquified natural gas storage tank in fluid communication with the bulk storage tanks, wherein compressed natural gas resulting from vaporization of the liquified natural gas within the liquified natural gas storage tank is transferred to the bulk storage tanks as a supplemental source of compressed natural gas, or wherein liquified natural gas is vaporized in an ambient vaporizer and delivered to the bulk or dispensing storage tanks.

8 Claims, 2 Drawing Sheets

COMPRESSED AND LIQUIFIED NATURAL GAS STORAGE AND DISPENSING SYSTEM

This application claims the benefit of U.S. Provisional Patent Application Ser. No. 61/855,363, the disclosure of which is incorporated herein by reference.

BACKGROUND OF THE INVENTION

This invention relates generally to the field of receiving, storing and dispensing compressed natural gas, and more particularly relates to systems and methods for receiving natural gas from pipelines or delivery vehicles, compressing and storing the natural gas, and dispensing the natural gas into vehicles from fuel islands. The invention also relates to liquified natural gas storage and dispensing systems and methods. Even more particularly, the invention relates to such systems and methods wherein both compressed natural gas and liquified natural gas are stored and/or dispensed at a common location.

Compressed natural gas (CNG) is essentially purified methane gas stored at high pressure which is a cleaner and cheaper alternative to gasoline or diesel fuel for powering motor vehicles and the like. The natural gas is compressed to less than 1% of its normal volume at standard atmospheric pressure.

Using CNG for motor vehicle fuel is relatively new in the U.S., although it is more widespread in certain foreign countries. It is anticipated that most CNG fuel islands, designed and structured to dispense CNG to individual vehicles in the manner of standard gas stations, will obtain natural gas by direct connection to utility pipelines, as provided by municipal infrastructure. However, the gas pressure and volume from these pipelines is insufficient to directly support fast-fill, i.e., CNG-on-demand, islands. Inconsistent demands for natural gas throughout the day by neighboring customers sharing the pipeline create widely disparate volume and pressures that are detrimental for optimum operation of open-traffic fast-fill CNG fuel islands directed at refueling motor vehicles. Decreased pipeline pressure increases the time required to fuel vehicles, and as more vehicles convert to CNG, the fuel demand may exceed the supply available to any given fuel island because the island is dependent on the supply offered by the neighborhood pipeline at any given time.

In my pending U.S. patent application Ser. No. 14/161,245, the above discussed problems are addressed by providing a system of CNG storage tanks and gas compressors which are designed to collect, store and compress natural gas on site in a manner that accounts for fluctuations in gas supply from pipelines or other sources and accounts for fluctuations in vehicle refueling demands. However, in some circumstances where natural gas supply is highly variable or inconsistent and where dispensing demands are very high, there may still be shortfalls in optimum delivery the CNG to vehicles.

Liquified natural gas (LNG) is essentially purified methane gas that is converted to liquid form for easier storage and transport. LNG takes up about $1/600^{th}$ of the volume of the natural gas at standard atmospheric pressure, the methane being reduced to approximately minus 162 degrees C. (minus 260 degrees F.). The LNG is typically stored as a boiling cryogen, as a portion of the LNG will vaporize within the storage tank. The heat for the phase change cools the remaining liquid in the tank, a process also known as auto-refrigeration. The resulting boil-off gas is then often compressed and fed into natural pipeline networks or used for fuel.

It is an object of this invention to provide an improved CNG receiving, storing and dispensing fuel island less susceptible to the problems resulting from fluctuating supply and demand, wherein a supplemental supply of LNG is stored on site, the LNG providing additional CNG to the CNG storage and/or dispensing tanks as needed to maintain proper pressures and quantity of CNG, as well as optionally providing LNG directly to vehicles adapted to operate on LNG. The LNG is primarily utilized to refill the storage and/or dispensing tanks in order to provide a secondary source of CNG and/or to maintain the tanks at the desired high pressure.

SUMMARY OF THE INVENTION

In various embodiments, the invention presents a compressed natural gas (CNG) fast-fill receiving, storing and dispensing fuel island with supplemental storage of LNG. The fuel island comprises CNG storage/dispensing tanks, the tanks preferably receiving natural gas from a gas utility pipeline and then dispensing CNG on demand to refuel CNG adapted vehicles. Vaporized natural gas from one or more LNG storage tanks is delivered to the CNG storage tanks as needed to supplement the supply of CNG initially received from the gas utility pipeline. The boil-off gas from the LNG may be delivered directly to the CNG storage and/or dispensing tanks, or the LNG may be pumped to an ambient vaporizer and/or heat exchanger to covert the LNG to CNG for delivery to the CNG storage and/or dispensing tanks, and/or directly to LNG dispensers for refueling of vehicles adapted to utilize LNG.

In a preferred embodiment, the CNG fast-fill receiving, storing and dispensing fuel island comprises preferably at least two banks or sets of tanks—a bank of "bulk storage tanks" and a bank of "dispensing storage tanks". The bulk storage tanks are connected to the natural gas utility pipeline and are refilled to capacity throughout the course of the day via open and continuous access to the pipeline, the bulk storage tanks being refilled at the relatively low flow rate produced by pipeline pressure via compressors that raise the pressure to 5000 psi for example. The dispensing storage tanks receive the gas from the bulk storage tanks as needed as a result of the fuel being dispensed from the dispensing tanks to the CNG dispensers and into the motor vehicles. The depletion is measured in pressure, such that when the dispensing storage tanks go below a designated minimum pressure, typically 3600 psi, valves that connect the two banks of tanks through a manifold system of pipes automatically transfer the gas stored in the bulk storage tanks into the dispensing storage tanks. To insure constant high pressure within the dispensing tanks, the gas from the bulk storage tanks is recompressed up to 5000 psi for example prior to delivery to the dispensing storage tanks. Because a relatively low flow rate for filling the bulk storage tanks is acceptable, relatively low horse power compressors may be utilized. Likewise, relatively low horsepower compressors may be utilized to recompress the gas delivered from the bulk storage tanks, since the gas will be at a pressure of greater than 3600 psi.

DETAILED DESCRIPTION

With reference to the drawings, embodiments of the invention will now be described in enabling detail. The invention is a compressed natural gas (CNG) fuel island system and method of dispensing CNG to individual CNG adapted vehicles on demand. The term "fuel island" is used herein to refer to a facility in the nature of a gas station, wherein the fuel island broadly comprises receiving, storage and dispensing apparatuses for CNG. In the invention as presented herein, the fuel island further comprises receiving, storing and dispensing apparatuses for liquified natural gas (LNG), wherein vaporized natural gas from the LNG storage apparatuses are delivered to the CNG storage apparatuses, such that the LNG is available as a supplement to the CNG when needed.

Figure 1:
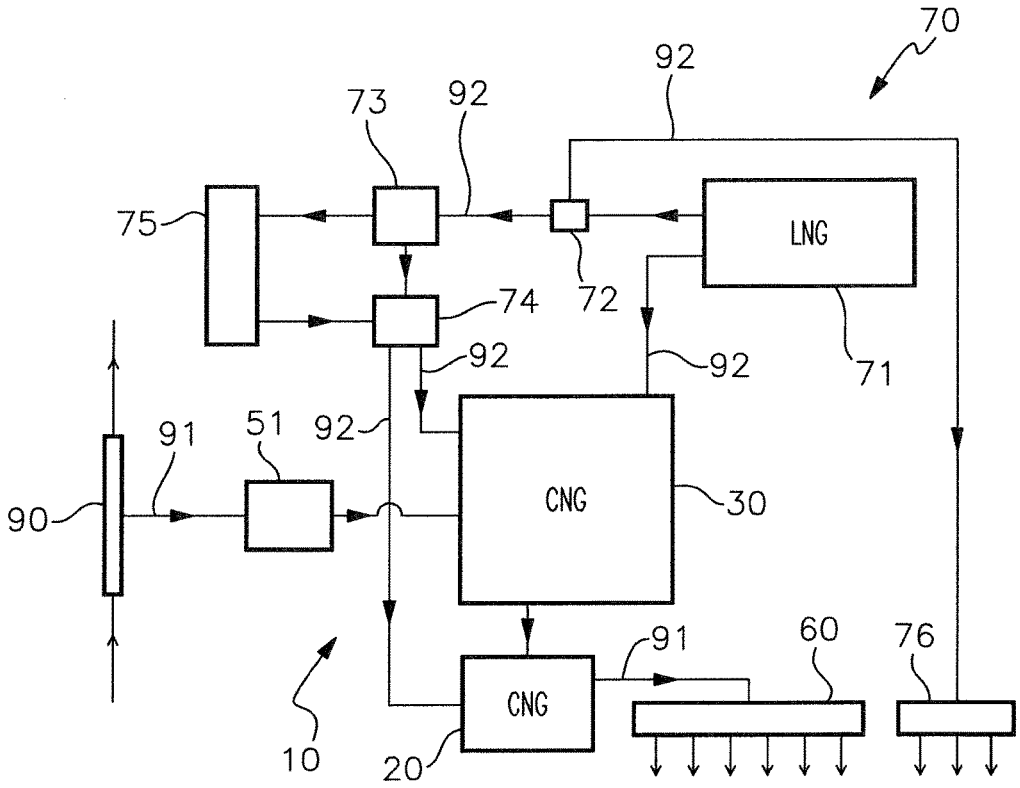
FIG. 1 is a schematic illustration of a first embodiment of the CNG fast-fill receiving, storing and dispensing fuel island system with a supplemental LNG storage and dispensing system.

A first embodiment of the system and method is shown in FIG. 1. This embodiment of the method and system is a CNG receiving, storing and dispensing fast-fill fuel island system 10 adapted to receive vehicular traffic acquiring CNG on demand, the system 10 shown as preferably comprising CNG storage/dispensing tanks, shown as a bank 20 of one or more dispensing storage tanks and a bank 30 of one or more bulk storage tanks. The CNG bulk storage bank 30 is connected to the natural gas utility pipeline 90 and continuously filled to capacity throughout the course of the day as needed via open and continuous conduits 91 communicating with the pipeline 90, with the gas being suctioned from the pipeline 90 and compressed by a primary compressor 51 to the desired pressure (5000 psi for example). The CNG dispensing storage bank 20 receives the gas from the CNG bulk storage bank 30 as needed as a result of the fuel being dispensed through the CNG fuel dispensers 60. The depletion of the CNG dispensing storage bank 20 is measured in pressure, such that when the pressure goes below a designated minimum pressure (3600 psi for example), typically chosen to be the minimum pressure required for delivery of the CNG into the motor vehicles in a reasonably short time period, CNG gas stored in the CNG bulk storage bank 30 is transferred into the CNG dispensing storage bank 20. The initial source of the natural gas can be a municipal utility gas pipeline 90, a mobile CNG tube trailer (not shown) or other means.

The CNG receiving, storing and dispensing fast-fill fuel island system 10 further comprises a LNG receiving, storing and dispensing supplemental system 70. The system comprises at least one LNG storage tank 71 that receives and maintains LNG delivered from off-site. As vaporization, also known as boil-off, of the LNG occurs within LNG stage tank 71, CNG is formed. This LNG and vaporization CNG is utilized as a supplemental source of CNG for the fuel island system 10 in addition to the CNG received through the CNG pipeline 90 or equivalent means. Both the supplemental CNG and the LNG is available to address potential problems resulting from excessive vehicle demand, shortages or inconsistent natural gas delivery from off-site, or drops in pressure within the CNG banks 20 or 30.

The LNG system 70 is structured such that this supplemental CNG may be distributed from the LNG tank 71 through supplemental conduits 92 directly to the CNG storage bank 30 in order to refill or raise the pressure in the CNG storage bank 30. In a second scenario, the LNG is extracted from the LNG tank 71 by a cryogenic pump 72 and delivered to an ambient vaporizer 73 for conversion to CNG. Optionally, this converted CNG or additional LNG may then be processed through a heat exchanger 75 to produce a greater amount of CNG. After being treated in an odorizer 74, the CNG is then delivered to CNG storage bank 30 or CNG dispensing bank 20 to refill or raise the pressure within the banks 30/20. In still another embodiment, LNG from the LNG storage tank 71 may be delivered directly to LNG fuel dispensers 76 for the refueling of LNG adapted vehicles.

Figure 2:
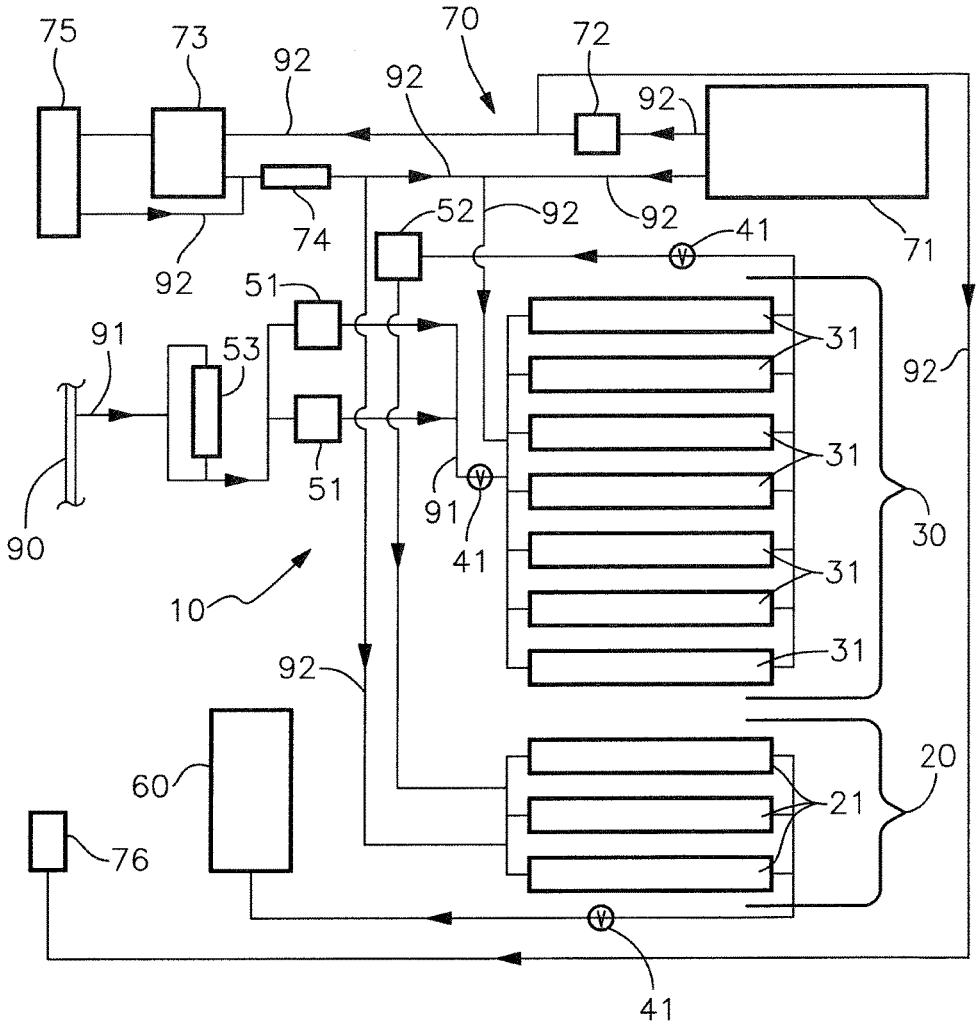
FIG. 2 is a schematic illustration of an alternate embodiment of the CNG fast-fill receiving, storing and dispensing fuel island system with a supplemental LNG storage and dispensing system.

An alternative embodiment of the method and system is shown in FIG. 2, which illustrates a CNG receiving, storing and dispensing fast-fill fuel island system 10 adapted to receive vehicular traffic acquiring CNG on demand, the system 10 comprising preferably at least two banks or sets of CNG storage tanks—a bank 20 of dispensing storage tanks 21 and a bank 30 of bulk storage tanks 31. The bulk storage tanks 31 are connected to the natural gas utility pipeline 90 and are continuously being filled to capacity throughout the course of the day as needed via open and continuous conduits 91 communicating with the pipeline 90, with the gas being suctioned from the pipeline 90 and compressed by primary compressors 51 to the desired pressure (5000 psi for example). The dispensing storage tanks 21 receive the gas from the bulk storage tanks 31 as needed as a result of the fuel being dispensed through the CNG fuel dispensers 60. A dryer system 53 may be provided between the pipeline 90 and the primary compressors 51. The depletion of the dispensing storage tanks 21 is measured in pressure, such that when any of the dispensing storage tanks 21 go below a designated minimum pressure (3600 psi for example), typically chosen to be the minimum pressure required for delivery of the CNG into the motor vehicles in a reasonably short time period, valves 41 that connect the two banks 20/30 of tanks 21/31 through a manifold system of pipes 40 automatically transfer the gas stored in the bulk storage tanks 31 into the dispensing storage tanks 21. To insure constant high pressure within the dispensing storage tanks 21, the gas from the bulk storage tanks 31 is recompressed prior to delivery to the dispensing storage tanks 21 by secondary compressors 52.

The storage tank banks 20 and 30 are connected together with manifold pipelines 40 and appropriate valves 41. Preferably the tanks 21/31 are resin composite tanks of the type known in the industry as type 4, 4/5 or 5, as tanks of this composition are capable of holding more gas at high pressure and at lower cost of manufacture than conventional metal tanks. The number of tanks 21/31 is dependent on how much fuel will need to be stored and how much fuel should be available for dispensing at a particular site dependent on demand. A sufficient number of dispensing storage tanks 21 should be provided to meet the projected peak fueling requirements of the fuel island system 10, to be measured in standard cubic feet per minute (scfm). The number of bulk storage tanks 31 is determined as a result of the expected demand on the dispensing storage tanks 21, but there will be a significantly greater number of bulk storage tanks 31 than dispensing storage tanks 21. The bulk storage tanks 31 are filled in sequence through the action of primary compressors 51 that compress the natural gas delivered at low pressure from the pipeline 90 or other source up to a desired high pressure (5000 psi for example), and are filled whenever the pressure within a bulk storage tank 31 falls below a predetermined pressure, regardless of whether or not fuel is being dispensed through a dispensing storage tank 21. Because of the large number of bulk storage tanks 31, the refilling process can be at a relatively low flow rate, since the supply of natural gas is continuous and draw down on the bulk storage tanks 31 occurs only during refilling of the dispensing storage tanks 21 whenever pressures in the dispensing storage tanks 21 are reduced to predetermined minimum levels (3600 psi for example).

Compressors 51/52 draw the gas through the system 10 via suction, the compressors 51/52 being activated by sensors when pressure in either the bulk storage tanks 31 or the dispensing storage tanks 21 is reduced to a predetermined level. The valves 41 that transfer the gas to and from tanks 21/31 and compressors 51/52 operate automatically based on pressures, timers and temperatures, with the valves 41 being monitored by a sequencing panel. The sequencing panel will also have the ability to allow manual override of the valves 41. The goal of the storage system 10 is to insure the dispensing storage tanks 21 are filled to maximum fuel capacity at all times. The storage system 10 will also have safety monitoring for fire, smoke, heat, and UV hydrocarbon detection with overhead fire protection deployment such as sprinkler systems loaded with fire suppressants.

The CNG receiving, storing and dispensing fast-fill fuel island system 10 of this FIG. 2 embodiment further comprises a LNG receiving, storing and dispensing supplemental system 70. The system comprises at least one LNG storage tank 71 that receives and maintains LNG delivered from off-site. As vaporization, also known as boil-off, of the LNG occurs within LNG stage tank 71, CNG is formed. This LNG and vaporization CNG is utilized as a supplemental source of CNG for the fuel island system 10 in addition to the CNG received through the CNG pipeline 90 or equivalent means. Both the supplemental CNG and the LNG is available to address potential problems resulting from excessive vehicle demand, shortages or inconsistent natural gas delivery from off-site, or drops in pressure within the CNG banks 20 or 30.

The LNG system 70 is structured such that this supplemental CNG may be distributed from the LNG tank 71 through supplemental conduits 92 directly to the CNG storage tanks 31 in order to refill or raise the pressure in the CNG storage tanks 31. In a second scenario, the LNG is extracted from the LNG tank 71 by a cryogenic pump 72 and delivered to an ambient vaporizer 73 for conversion to CNG. Optionally, this converted CNG or additional LNG may then be processed through a heat exchanger 75 to produce a greater amount of CNG. After being treated in an odorizer 74, the CNG is then delivered to CNG storage tanks 31 or CNG dispensing tanks 21 to refill or raise the pressure within the tanks 31/21. In still another embodiment, LNG from the LNG storage tank 71 may be delivered directly to LNG fuel dispensers 76 for the refueling of LNG adapted vehicles.

A major advantage of the system as described is its ability to provide to the CNG dispensers 60 a sufficient quantity of CNG at the desired minimum pressure for efficient delivery to the motor vehicles, wherein the source of the natural gas is a low pressure, low flow rate and fluctuating volume source, by utilizing relatively low horsepower compressors 51/52. For example, 50-150 horsepower compressors 51/52 may be utilized. Conventionally such low horsepower compressors would not be able to provide CNG above a minimum desired psi at a flow rate suitable for refilling vehicles in a timely manner, and therefore known systems utilize compressors of much greater horsepower, which are incrementally more expensive. Because the filling of the bulk storage tanks 31 does not need to be rapid and instead may be accomplished over long time periods, and because the CNG delivered from the bulk storage tanks 31 is passed through secondary compressors to recompress the CNG prior to delivery to the dispensing storage tanks 21, these 50-150 horsepower compressors are sufficient. In addition, the utilization of LNG stored on site and the CNG produced by vaporization of the LNG provides supplemental CNG when needed.

PROPHETIC EXAMPLE

As shown in FIG. 1, natural gas comes in off natural gas pipeline 90 from existing municipal gas utility infrastructure onto the property through conduit 91. The gas is sucked through the conduit 91 by suction created by a pair of primary compressors 51. The conduit 91 carries the gas through a dryer system 53 into the primary compressors 51 where it is compressed to 5,000 psi or higher and sequenced throughout the manifold pipes 40 and into the bulk storage tanks 31. In the prophetic example, there are 10 total cylindrical storage tanks 21 and 31. These 10 tanks are partitioned into two sets or banks, shown as bank 20 of the dispensing storage tanks 21 and bank 30 of the bulk storage tanks 31.

Bank 20 provides fuel to the fuel dispensers 60 on an on-demand basis. When the pressure within the dispensing storage tanks 21 falls below 3600 psi, valves 41 open to draw gas from bank 30 into bank 20, the gas drawn from tanks 31 being recompressed to at least 5,000 psi prior to delivery to bank 20. Preferably, gas will be drawn from tanks 31 sequentially, such that when pressure in a first bulk storage tank 31 falls below the predetermined minimum pressure, output from the first tank 31 is stopped and gas is taken from a second tank 31, etc., until all dispensing tanks 21 are refilled. When output from the first tank 31 is stopped, or even possibly during the delivery of gas from the first tank 31, primary compressors 51 start refilling of this first bulk storage tank 31 from the natural gas source pipeline 90. This system insures that there will always be a sufficient supply of natural gas at the required pressure (5000 psi) to be used as needed by fuel island demand.

Preferably, the tanks 21/31 in the example are designed to handle at least 5,000 psi, and preferably higher, and should be cylindrical and double stacked; a suitable size being 21 inches in diameter and 84 inches long, so they can fit below grade into the fuel island culvert design of patent application Ser. No. 13/506,898. As previously discussed, type 4, 4/5 or 5 tanks composed of a resin or hybrid are preferred. The same system can be employed above ground, independent of the fuel island culvert design. The higher the psi, the more gas can be stored in the tanks 21/31. Whenever psi falls to 3,600 or below, the tanks 21/31 will automatically refill from their respective source via the compressor units 51/52. In the event that there is an insufficient supply of CNG available for dispensing, the supplemental CNG from the LNG system 70 is utilized as described above.

The system 10 as described comprises features advantageous, novel and non-obvious over the known prior art systems. The system allows for reduced time to fill-up using CNG, similar to conventional fueling with gasoline or diesel; addresses problem of insufficient CNG quantity or pressure by utilizing the LNG supplemental CNG source; greater access to CNG fueling for non-fleet vehicles, as most CNG stations are restricted to fleets due to the time it takes to fill a vehicle and the limited supply of CNG available for compression; which results in most fleet CNG stations scheduling fill-ups by appointment only; uninterrupted, continuous and systematic supply of CNG fuel to dispenser(s); CNG stations will be more attractive to investors and more accepting by the public because CNG will be dispensed faster and efficiently without the fear of spending too much time at a dispenser and without fear of not having enough fuel to fill up at a convenient time and will have lower installation and operational costs.

It is contemplated and understood that equivalents and substitutions for certain elements described above may be obvious to those of ordinary skill in the art, and therefore the true scope and definition of the invention is to be as set forth in the following claims.

I claim:

1. A method of refilling CNG adapted motor vehicles comprising the steps of:

providing a CNG storage and dispensing system adapted to deliver CNG to motor vehicles, the system comprising bulk storage tanks in fluid communication with a natural gas supply source;

dispensing storage tanks in fluid communication with said bulk storage tanks and in fluid communication with fuel dispensers;

at least one primary compressor receiving natural gas from said natural gas supply source, compressing the natural gas to produce CNG, and delivering said CNG to said bulk storage tanks to maintain said bulk storage tanks at a desired pressure;

at least one secondary compressor receiving said CNG from said bulk storage tanks, recompressing said CNG, and delivering said CNG to said dispensing storage tanks;

measuring the bulk storage tank pressure in said bulk storage tanks;

measuring the dispensing storage tank pressure in said dispensing storage tanks;

transferring said CNG from said bulk storage tanks to said dispensing storage tanks when said dispensing storage tank pressure drops below a first designated minimum pressure for said dispensing storage tanks;

providing a LNG storage tank in fluid communication with said bulk storage tanks, storing LNG in said LNG storage tank, and allowing said LNG to vaporize within said LNG storage tank to produce vaporized CNG;

transferring said vaporized CNG from said LNG storage tank to said bulk storage tanks when said bulk storage tank pressure drops below a second designated minimum pressure for said bulk storage tanks and said CNG produced by said at least one primary compressor is insufficient to maintain said bulk storage tanks at said second desired pressure; and delivering CNG from said dispensing tanks to said fuel dispensers and refilling the motor vehicles.

2. The method of claim 1, further comprising the steps of:

providing a pump in fluid communication with said LNG storage tank and providing an ambient vaporizer in fluid communication with said LNG storage tank and said bulk storage tanks; and pumping said LNG from said LNG storage tank to said ambient vaporizer, converting said LNG to CNG and delivering said converted CNG to said bulk storage tanks when said bulk storage tank pressure drops below said second designated minimum pressure for said bulk storage tanks and said CNG produced by said at least one primary compressor is insufficient to maintain said bulk storage tanks at said second desired pressure.

3. The method of claim 2, further comprising the steps of:

providing LNG fuel dispensers, and wherein said pump is also in fluid communication with said LNG fuel dispensers, and pumping said LNG from said LNG storage tank to said LNG fuel dispensers.

4. The method of claim 1, further comprising the steps of:

providing LNG fuel dispensers, and wherein said pump is also in fluid communication with said LNG fuel dispensers, and pumping said LNG from said LNG storage tank to said LNG fuel dispensers.

5. The method of claim 1, wherein said LNG storage tank is also in fluid communication with said dispensing storage tanks, and delivering said vaporized CNG to said dispensing storage tanks when said dispensing storage tank pressure drops below said first designated minimum pressure for said dispensing storage tanks.

6. The method of claim 5, further comprising the steps of:

providing a pump in fluid communication with said LNG storage tank and providing an ambient vaporizer in fluid communication with said LNG storage tank, said bulk dispensing tanks and said dispensing storage tanks; and pumping said LNG from said LNG storage tank to said ambient vaporizer, converting said LNG to CNG and delivering said converted CNG to said bulk storage tanks when said bulk storage tank pressure drops below said second designated minimum pressure for said bulk storage tanks and said CNG produced by said at least one primary compressor is insufficient to maintain said bulk storage tanks at said second desired pressure, and delivering said converted CNG to said dispensing storage tanks when said dispensing storage tank pressure drops below said first designated minimum pressure for said dispensing storage tanks.

7. The method of claim 6, further comprising the steps of:

providing LNG fuel dispensers, and wherein said pump is also in fluid communication with said LNG fuel dispensers, and pumping said LNG from said LNG storage tank to said LNG fuel dispensers.

8. The method of claim 5, further comprising the steps of:

providing LNG fuel dispensers, and wherein said pump is also in fluid communication with said LNG fuel dispensers, and pumping said LNG from said LNG storage tank to said LNG fuel dispensers.

* * * * *